US006906579B2

(12) United States Patent
Masleid et al.

(10) Patent No.: US 6,906,579 B2
(45) Date of Patent: Jun. 14, 2005

(54) OPTIMAL INDUCTOR MANAGEMENT

(75) Inventors: Robert P. Masleid, Monte Sereno, CA (US); Christopher Giacomotto, Mountain View, CA (US); Akihiko Harada, San Jose, CA (US)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/342,588

(22) Filed: Jan. 14, 2003

(65) Prior Publication Data

US 2004/0135622 A1 Jul. 15, 2004

(51) Int. Cl.[7] ..... G05F 3/02

(52) U.S. Cl. ..... 327/538; 327/530; 323/269; 323/272; 307/43; 307/127; 307/131

(58) Field of Search ..... 327/143, 148, 327/157, 407, 408, 409, 410, 411, 412, 413, 484, 540, 538, 530; 307/43, 64, 87, 127, 131; 323/269, 271, 272, 282, 284

(56) References Cited

U.S. PATENT DOCUMENTS

| | | | | |
|---|---|---|---|---|
| 5,608,312 A | * | 3/1997 | Wallace | 323/224 |
| 5,646,572 A | | 7/1997 | Masleid | |
| 5,973,547 A | | 10/1999 | Ang et al. | |
| 5,982,160 A | * | 11/1999 | Walters et al. | 323/282 |
| 6,028,417 A | | 2/2000 | Ang et al. | |
| 6,069,521 A | | 5/2000 | Taylor et al. | |
| 6,198,325 B1 | | 3/2001 | Ang et al. | |
| 6,215,290 B1 | * | 4/2001 | Yang et al. | 323/282 |
| 6,333,623 B1 | * | 12/2001 | Heisley et al. | 323/280 |
| 6,424,129 B1 | * | 7/2002 | Lethellier | 323/272 |
| 6,433,521 B1 | * | 8/2002 | Chen et al. | 323/224 |
| 6,580,597 B2 | * | 6/2003 | Kanouda et al. | 361/502 |
| 6,583,610 B2 | * | 6/2003 | Groom et al. | 323/288 |
| 6,696,825 B2 | * | 2/2004 | Harris et al. | 323/282 |
| 2002/0053897 A1 | * | 5/2002 | Kajiwara et al. | 323/272 |
| 2002/0125871 A1 | * | 9/2002 | Groom et al. | 323/284 |
| 2004/0000895 A1 | * | 1/2004 | Solivan | 323/271 |
| 2004/0012425 A1 | * | 1/2004 | Hsu | 327/157 |

OTHER PUBLICATIONS

Michael Ang, Raoul Salem and Alexander Taylor, WP 26.7 "An On–chip Voltage Regulator Using Switched Decoupling Capacitors", 2000 IEEE International Solid–State Circuits Conference, Sun Microsystems Inc., Palo Alto, CA, U.S.A.

R. Jacob Baker, Harry W. Li, David E. Boyce, "CMOS Circuit Design, Layout, and Simulation", 1998, Chapter 24, pp. 579–616, IEEE, Piscataway, NJ, U.S.A.

Ivan Sutherland, Bod Sproull, David Harris, "Logical Effort Designing Fast CMOS Circuits", 1999, pp. 5–13, Morgan Kaufmann Publishers, Inc., San Francisco, CA, U.S.A.

* cited by examiner

*Primary Examiner*—Terry D. Cunningham
(74) *Attorney, Agent, or Firm*—Fenwick & West LLP

(57) ABSTRACT

In a packaged integrated circuit, the package inductance limits the rate at which off-chip current may be varied in response to a change in on-chip current demand of the integrated circuit. The present invention provides an on-chip voltage regulator circuit for regulating multi-cycle voltage fluctuations of an integrated circuit associated with changes in current demand of the integrated circuit. The voltage regulator sources current to prevent an undervoltage conditions and sinks current to prevent an overvoltage condition.

13 Claims, 15 Drawing Sheets

| | Enable Inputs | | Analog Nodes | | Capacitance Bridge Controls | | | | Maint. Controls | | Maintenance Bridge Controls | | | |
|---|---|---|---|---|---|---|---|---|---|---|---|---|---|---|
| State | e a | e m | Vout (Up) | Vout (Low) | a1 | b1 | a2 | b2 | m1 | m2 | a1 m | b1 m | a2 m | b2 m |
| Disabled Conditions | 0 | 0 | d | d | 1 | 0 | 1 | 0 | 1 | 0 | 1 | 0 | 1 | 0 |
| | 0 | 1 | d | d | 1 | 0 | 1 | 0 | 1 | 0 | 0 | 1 | 0 | 1 |
| | 1 | 0 | low | high | 1 | 0 | 1 | 0 | 1 | 0 | 1 | 0 | 1 | 0 |
| | 1 | 0 | low | low | 1 | 1 | 0 | 0 | 0 | 0 | 1 | 1 | 0 | 0 |
| | 1 | 0 | high | high | 0 | 0 | 1 | 1 | 1 | 1 | 0 | 0 | 1 | 1 |
| Maintenance | 1 | 1 | low | high | 1 | 0 | 1 | 0 | 1 | 0 | 0 | 1 | 0 | 1 |
| Charge APS (Vdd High) | 1 | 1 | low | low | 1 | 1 | 0 | 0 | 0 | 0 | 1 | 1 | 0 | 0 |
| Discharge APS (Vdd Low) | 1 | 1 | high | high | 0 | 0 | 1 | 1 | 1 | 1 | 0 | 0 | 1 | 1 |

FIG. 7

LOW PASS FILTER

OPTIMAL INDUCTOR MANAGEMENT

CROSS-REFERENCE TO RELATED APPLICATION

This application is related to the U.S. patent application entitled "Four-State Switched Decoupling Capacitor System For Active Power Stabilizer," with inventors Robert Paul Masleid, Christoper Giacomotto, and Akihiko Harada and having the same filing date as this application.

BACKGROUND OF THE INVENTION

1. Field of the Invention

This invention relates to regulating the voltage of an integrated circuit that has an associated package inductance and a variable current demand.

2. Description of Background Art

High-speed microprocessors are increasingly being designed to operate at a low operating voltage and with tight tolerances on acceptable power supply voltage. In particular, individual semiconductor devices and critical logical paths must be able to withstand worst-case voltage variations.

The current demands of a high-speed microprocessor circuit may change rapidly, making it difficult to control the on-chip voltage due to the significant package inductance of a packaged microprocessor circuit. Common package inductance values limit the ability of the package inductor to respond to changes in current demand in time scales less than about 10 nanoseconds. One conventional approach to this problem is to use passive decoupling capacitors to reduce the effect of current changes on microprocessor operating voltage. However, decoupling capacitors require significant die area, particularly if they are to be scaled to permit tight voltage regulation for large, sudden variations in current demand, such as multi-cycle changes in current demand associated with changes in the current required by the microprocessor for multiple clock cycles, such as changes in logic current. Additionally, conventional decoupling capacitors may have difficulty responding to abrupt, multi-cycle changes in current demand.

Therefore what is needed is an improved method of regulating the voltage of a microprocessor associated with changes in current demand of the microprocessor.

SUMMARY OF THE INVENTION

The present invention relates to a voltage regulator for use within an integrated circuit (IC) to regulate multi-cycle voltage fluctuations in the IC having an associated package inductance that limits the rate that current from a regulated voltage source may change in response to a change in current demand of the IC. The voltage regulator sinks current when the operating voltage of the IC rises above a threshold upper trigger voltage indicative of a multicycle decrease in current demand that might lead to an overvoltage condition. The voltage regulator sources current when the operating voltage of the IC decreases below a threshold lower trigger voltage indicative of a multicycle increase in current demand that might lead to an undervoltage condition. In one embodiment, the voltage regulator includes at least two capacitors that are coupled in parallel to sink current, coupled in series to source current, and are restored to a voltage less than a target operating voltage by a voltage divider to maintain the regulator's ability to sink or source current.

BRIEF DESCRIPTION OF THE DRAWINGS

FIG. 7 illustrates an exemplary truth table for the compact active power stabilizer.

DETAILED DESCRIPTION OF THE PREFERRED EMBODIMENTS

The present invention generally comprises an active power stabilizer circuit for regulating the voltage of a microprocessor circuit. In a microprocessor circuit the chip performance is limited by the voltage tolerance with every device and critical path of a logical circuit needing to be operable over an entire safe operating voltage range.

Figure 1A:
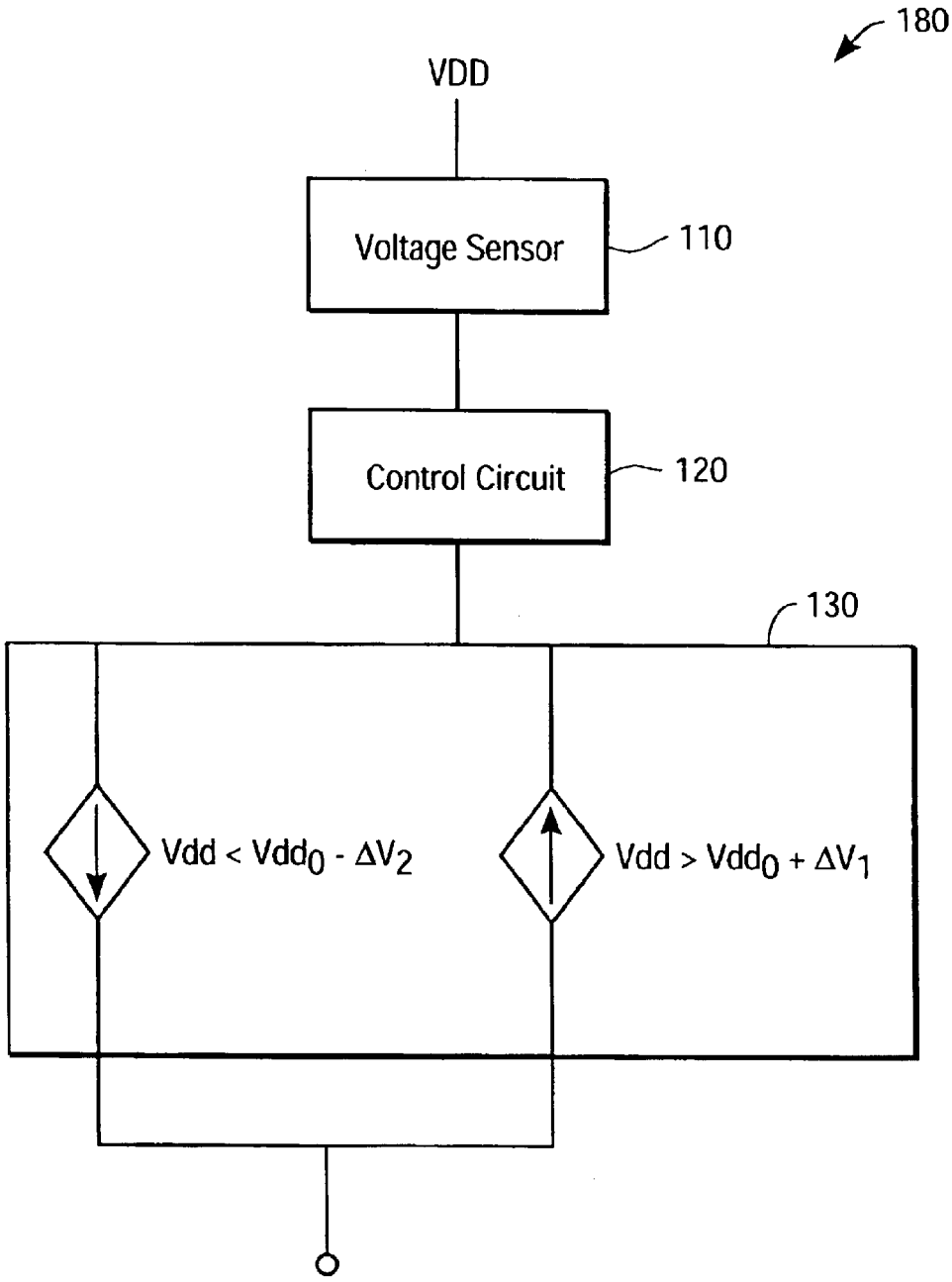
FIG. 1A is a block diagram illustrating the function of an active power stabilizer circuit.

FIG. 1A is a high level functional block diagram illustrating some aspects of the function of active power stabilizer (APS) 180 of the present invention. APS 180 is a voltage regulator circuit implemented as one or more circuits disposed on a microprocessor integrated circuit for regulating the on-chip voltage, particularly in response to multicycle changes in current demand. Examples of multicycle events include start-up, since logic paths typically turn on a number of cycles after the first clock leading edge. Other examples of multi-cycle events include clock stop events or sudden changes in current demand of logic circuits.

APS 180 includes a voltage sensor 110 to sense a microprocessor circuit operating voltage, Vdd, and compare it to a target regulated voltage, $Vdd_0$. A control circuit 120 determines whether Vdd is within a normal operational range. If the voltage exceeds a threshold high voltage level, $Vddh=Vdd_0+\Delta V1$, where $\Delta V1$, is a preselected voltage difference, the control circuit triggers a bi-directional current source 130 to sink current, thereby acting to prevent the microprocessor circuit voltage from exceeding a safe upper voltage level, Vmax. However, if the voltage decreases below a threshold low voltage level, $Vddl=Vdd_0-\Delta V2$ (where $\Delta V2$ is another preselected voltage difference, which may be equal to or different from $\Delta V1$) the control circuit triggers the bidirectional current source 130 to source current, thereby acting to prevent the microprocessor circuit voltage from decreasing below a safe lower voltage level, Vmin. Thus current is sourced or sinked only when the operating voltage deviates beyond defined threshold (trigger) voltages. As an illustrative example, for a microprocessor circuit having a nominal operating voltage of 1.0 volts, the voltage may need to be regulated to within plus or minus 5%. Furthermore, quasi-steady state operation may include a 1% ripple associated with normal clock operation. In one example, the voltage difference may be selected to be between that associated with normal clock ripple and the maximum safe operating range, such as upper and lower voltage levels corresponding to voltage variations of plus or minus 3%.

Figure 1B:
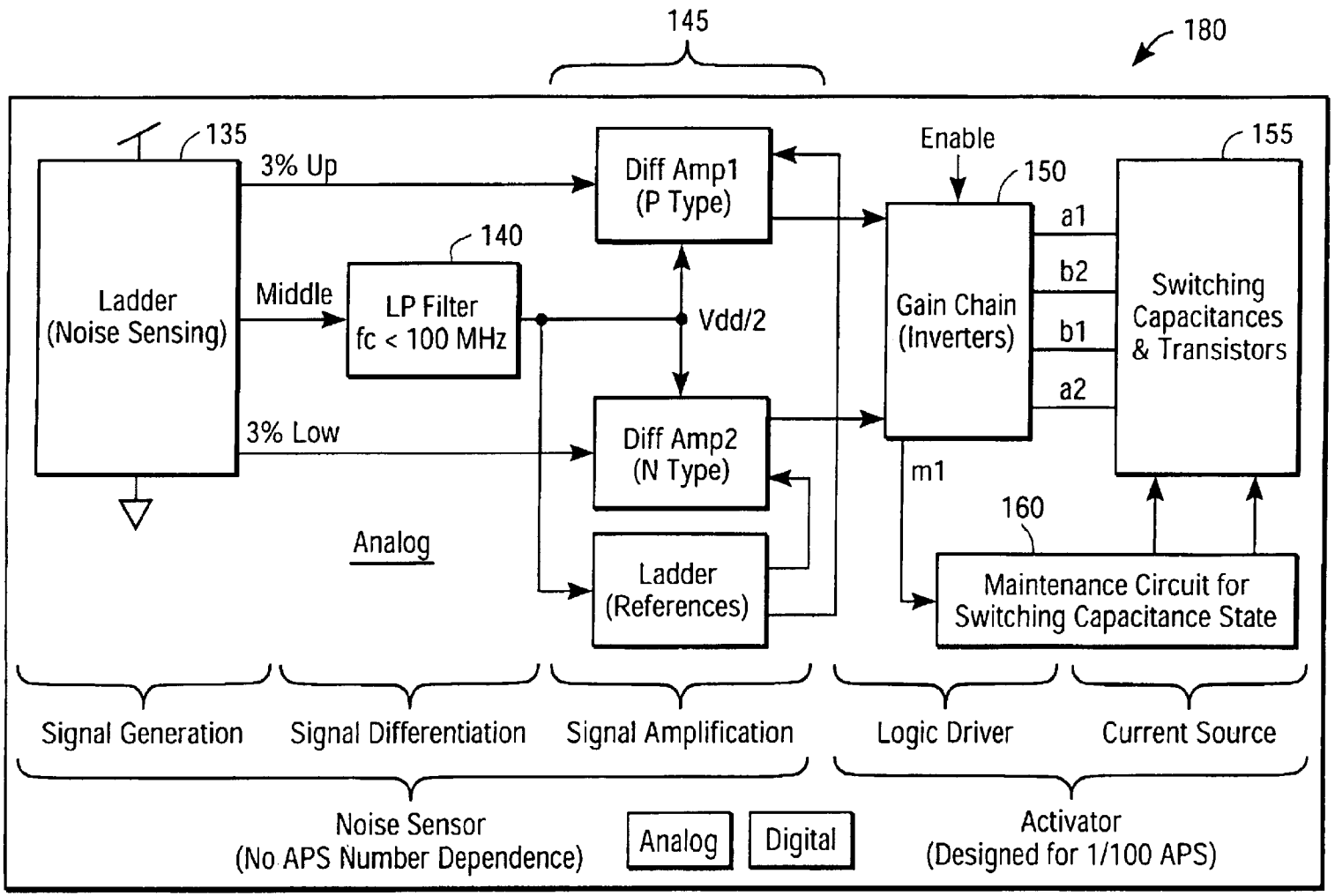
FIG. 1B is a block diagram illustrating an embodiment of an active power stabilizer circuit utilizing switched capacitors to source and sink current.

FIG. 1B is a functional block diagram illustrating in more detail one embodiment of APS 180 for a high speed microprocessor. A bank of capacitors is coupled to a switching network to serve as a current source and current sink. In one embodiment, an analog circuit, such as a ladder circuit 135, senses noise in a microprocessor voltage, Vdd, such as by comparing the instantaneous Vdd to the Vdd filtered by a low-pass filter 140. Differential amplifiers 145 are preferably used to amplify the signals. A logic driver 150 preferably has sufficient gain to respond rapidly to voltage shifts, and may, for example, include gain chains. If the voltage, Vdd, exceeds a first preselected percentage above the target $Vdd_0$ (e.g., +3%), logic driver 150 turns on switches in a capacitor bank 155 to couple capacitors in parallel to sink current. However, if the voltage decreases below a second preselected percentage below the target voltage $Vdd_0$ (e.g., −3%), logic driver 150 turns on switches in the capacitor bank 155 to couple capacitors in series to source current. A maintenance circuit 160 serves to restore the capacitors in the capacitor bank to a selected starting voltage when they are not required to source or sink current, e.g., a voltage preferably between 0.5 $Vdd_0$ and $Vdd_0$, such as a voltage of about 0.75 $Vdd_0$. In one embodiment APS 180 utilizes a voltage divider circuit to restore the capacitors to the selected starting voltage. An idle state may be included to force APS 180 to enter a low power, quiescent idle state, e.g., by turning off the switches in the switching network of the capacitor bank to decouple the capacitors.

Figure 2A:
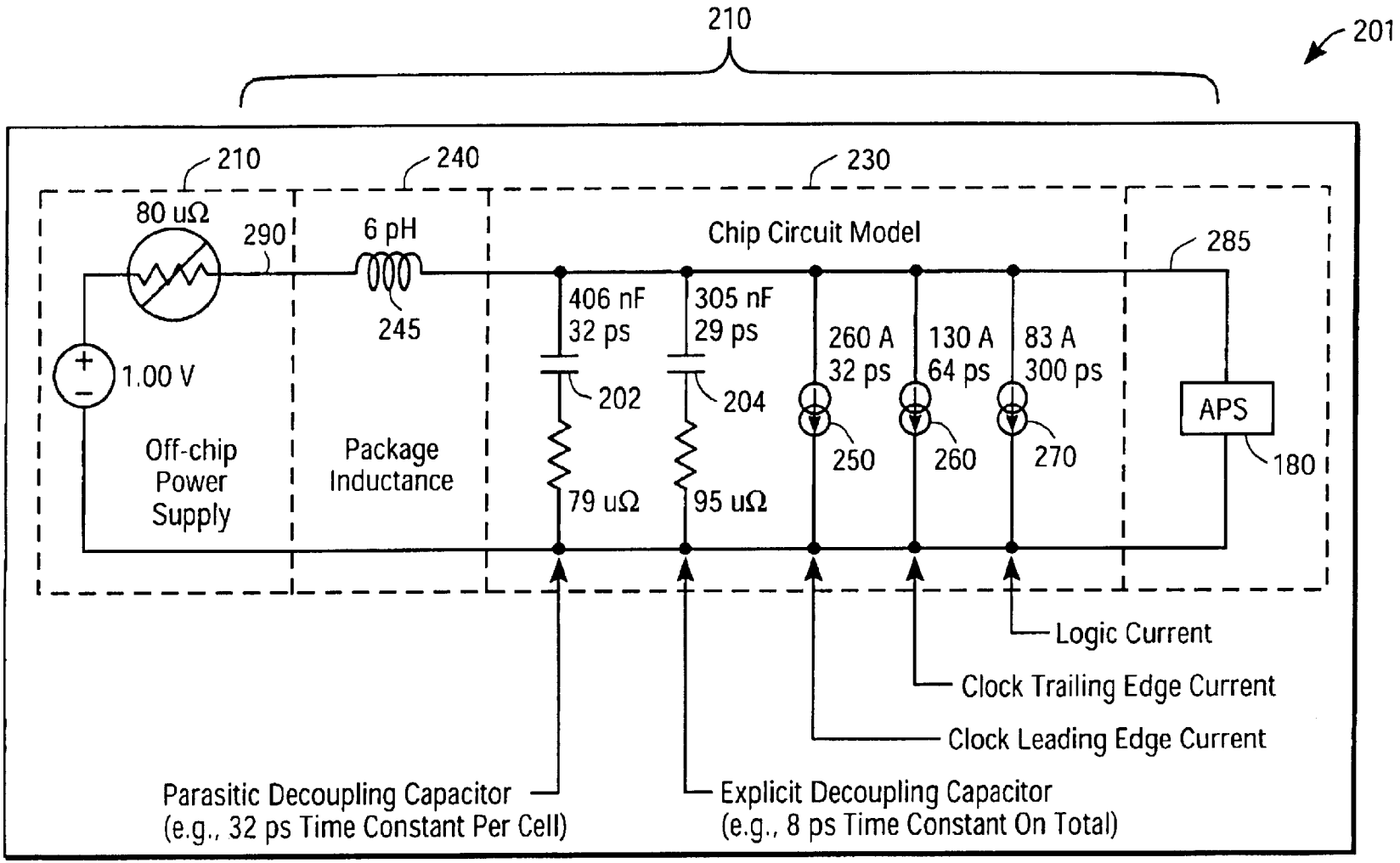
FIG. 2A is an equivalent circuit model of a microprocessor including at least one active power stabilizer circuit of the present invention.

FIG. 2A illustrates an equivalent circuit power model 201 for one embodiment of a microprocessor 210 including an active power stabilizer 180 according to the present invention. Each active power stabilizer 180 is coupled to the internal on-chip power grid of the microprocessor circuit 230 for sourcing or sinking current at an on-chip node 285. In some embodiments, APS circuits 180 are distributed throughout the on-chip power grid, although for the purposes of illustrating the equivalent circuit of the packaged microprocessor a single APS 180 is illustrated in FIG. 2A.

Microprocessor circuit 230 receives power from an external power supply at node 290. A regulated off-chip voltage generated by external off chip power supply is coupled to the microprocessor circuit 230 through and is impeded by the package inductance 245 associated with a package 240. By way of example, package 240 may include various power planes for distribution to the microprocessor circuit 230 within. Additionally, the package 240 may include several input/output points, or bumps, which allow external communication with the microprocessor circuit 230. Both the power planes and the bumps create a package inductance 245.

Over sufficiently long periods of time, the voltage coupled to microprocessor circuit 230 at node 285 will be the reference voltage from the external off chip power supply. However, over sufficiently short time periods the package inductance 245 limits the ability of the external power supply to regulate the microprocessor circuit voltage in response to changes in microprocessor load current. Consequently, microprocessor circuit 230 includes at least one decoupling capacitor, such as a parasitic decoupling capacitor 202 and explicit decoupling capacitor 204. Each decoupling capacitor 202 and 204 also has an associated series resistance that limits its response time. As described below in more detail, decoupling capacitors 202 and 204 have a limited capability to regulate the microprocessor circuit voltage in response to rapidly changing microprocessor currents.

The microprocessor circuit 230 can be modeled as having a time-varying current demand associated with clock leading edge current 250, clock trailing edge current 260, and a logic current 270. The clock currents 250 and 270 are typically periodic (cyclic) during normal operation. However, the clock current and logic current may also vary abruptly in a non-periodic fashion, such as during a clock stop event or a cold-start up. The logic current may also vary during start up or other conditions. Consequently, in addition to cyclic variations in current demand, the microprocessor circuit may also have abrupt increases or decreases in current demand that persist for multiple clock cycles.

The impedance from the inductor 245 limits the rate at which the off-chip power supply can respond to abrupt changes in current demand. This can be expressed mathematically as: $dI/dt=dV/L$, where $dI/dt$ is the time rate of change of the inductor current, dV is the differential voltage across the inductor 245 between nodes 285 and 290, and L is the package inductance.

Figure 2B:
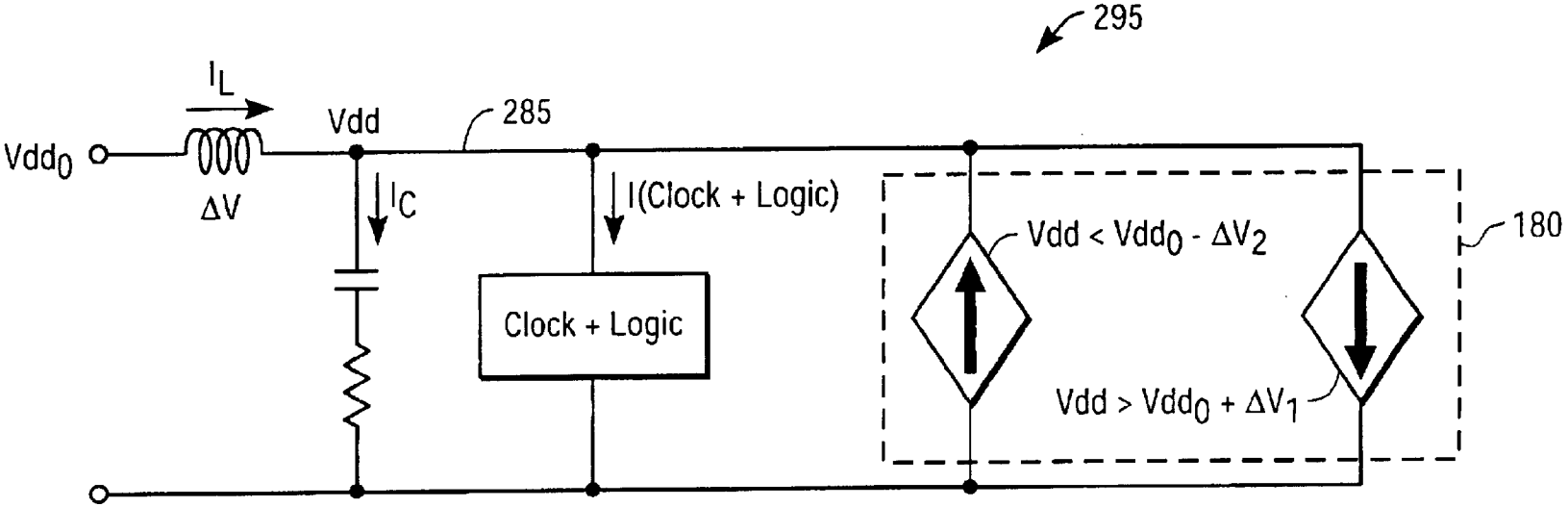
FIG. 2B shows a simplified current source model of the microprocessor.

FIG. 2B is a current model 295 of the equivalent circuit of FIG. 2A. The decoupling capacitors can be modeled as a single equivalent capacitor coupled to node 285 and receiving a capacitor current Ic. The clock and logic draw a total current I(clock+logic), and can be modeled as a single element drawing a time-varying current. The rate at which inductor current, $I_L$, may vary will depend on the voltage difference between the regulated voltage and the voltage at node 285. APS 180 is triggered to act as a significant current sink only when the voltage rises above an upper trigger voltage and is triggered to act as a significant current source only when the voltage at node 285 decreases below a lower trigger voltage. For even a comparatively low package inductance, such as 6 pH, the inductor 245 will have an associated response time greater than about 10 nanoseconds. Consequently, for very short time intervals (e.g., 1 nanosecond) the inductor current cannot change appreciably. This may result in a change in microprocessor circuit voltage at node 285 associated with charging or discharging the equivalent decoupling capacitors in accord with well-known current laws that the total current entering node 285 from the inductor must be balanced by the other currents entering/leaving node 285. For example, if the chip current demand I(clock+logic) suddenly drops, the inductor current for short time intervals will be approximately constant. Consequently, the decoupling capacitors will charge up, increasing the microprocessor circuit voltage at node 285 until the inductor can respond. Alternatively, if the current demand suddenly increases, the capacitors will discharge, decreasing the microprocessor circuit voltage at node 285 until the inductor can respond. However, in response to a multicycle change in current demand of I(clock+logic) the inductor may not be able to respond sufficiently fast to prevent an unsafe voltage condition, such as an unsafe high voltage or unsafe low voltage condition.

In the present invention, APS 180 acts to prevent the microprocessor circuit voltage from exceeding desired safe upper and lower levels. In preferred embodiments, APS 180 is configured to act as a supplemental current source that is turned on only when the voltage at node 285 decreases below a lower trigger voltage level, Vddl , indicative of a sudden increase in current demand of the microprocessor circuit. In preferred embodiments, APS 180 is also configured to act as a supplemental current sink that is turned on only when the voltage increases above an upper trigger voltage level, Vddh, indicative of a sudden decrease in current demand of the microprocessor circuit.

Figure 3A:
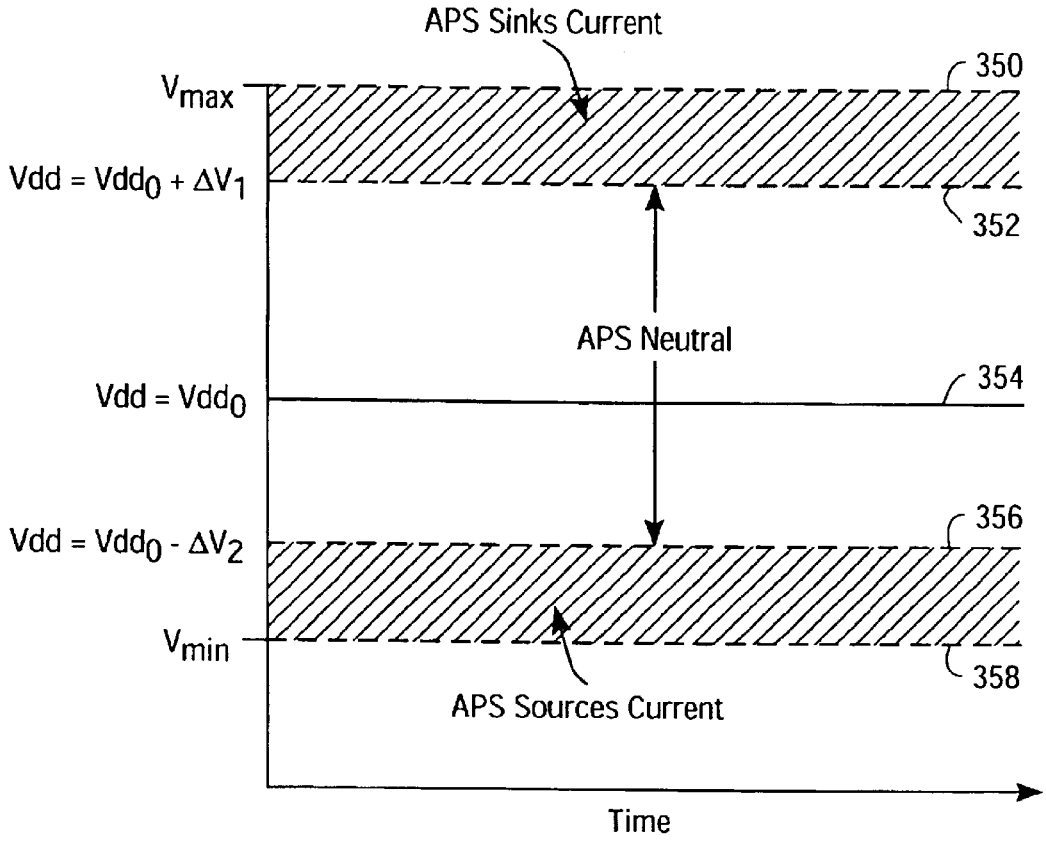
FIG. 3A is a diagram illustrating operational ranges of the active power stabilizer circuit of the present invention in a microprocessor.
Figure 3B:
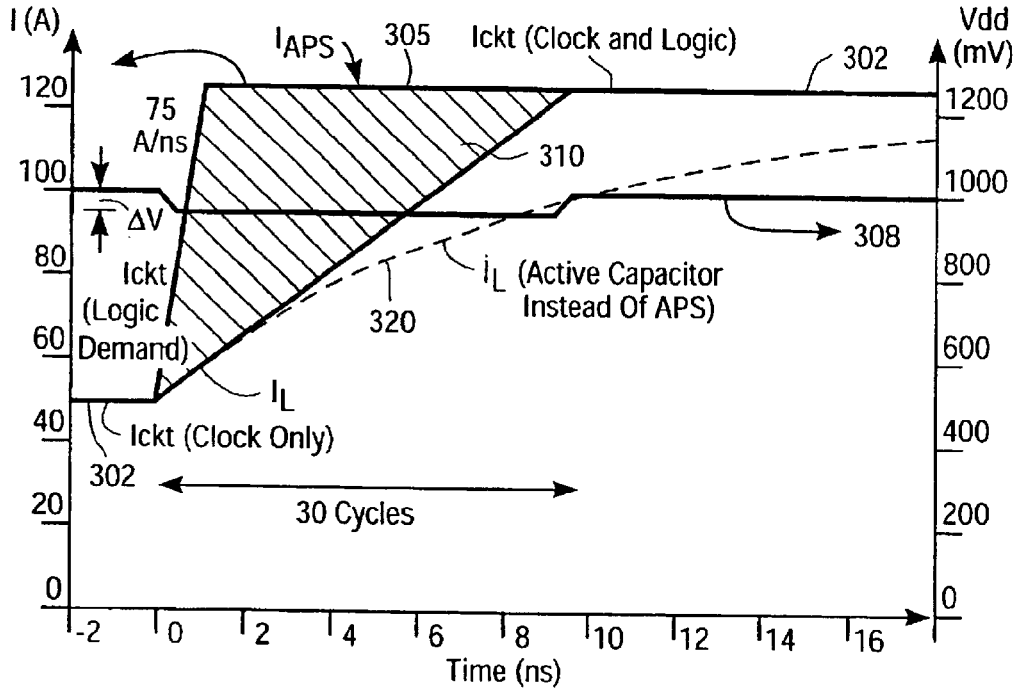
FIG. 3B is a diagram illustrating changes in inductor current and active power stabilizer response after a change in current demand resulting in a change in microprocessor operating voltage.
Figure 3C:
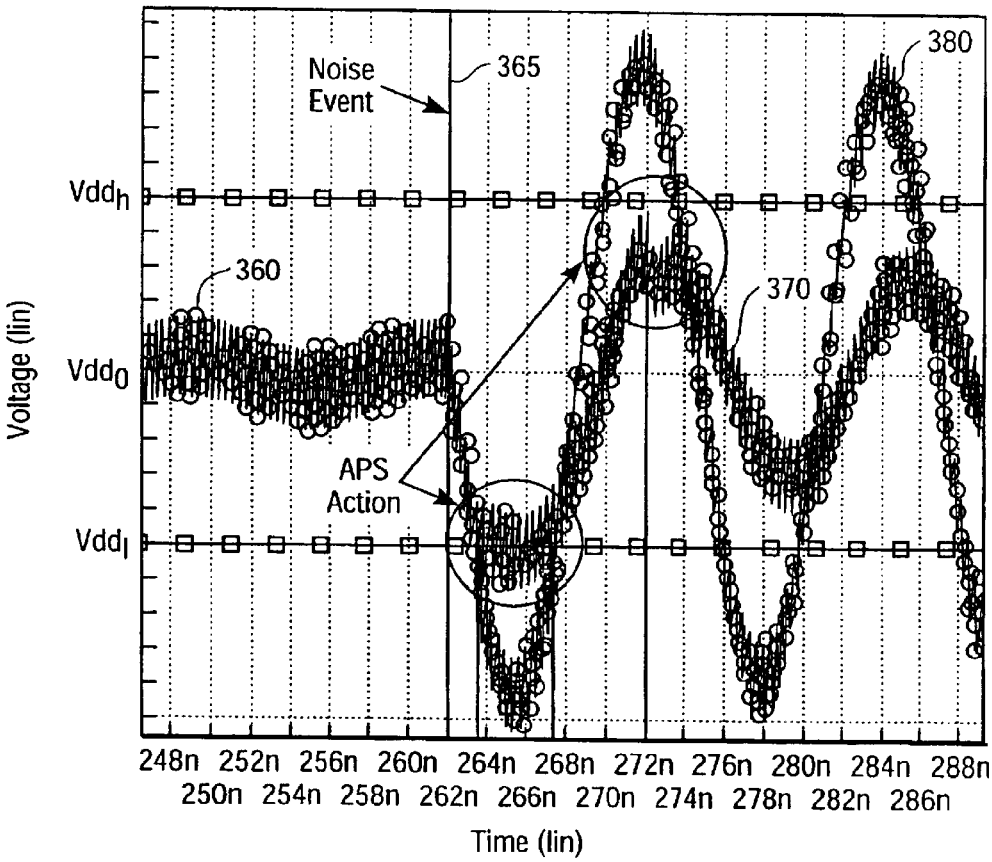
FIG. 3C shows plots of simulations of multicycle voltage response for circuits using an active power stabilizer of the present invention and for circuits not utilizing the active power stabilizer of the present invention.

Some of the benefits of the present invention may be understood with reference to FIGS. 3A–3C. As illustrated in FIG. 3A, there is target regulated voltage 354 Vdd0=V0. There is a safe maximum voltage 350, Vmax and a safe minimum voltage 358 Vmin for which the integrated circuit is designed to operate. The upper trigger voltage 352 that triggers APS 180 to sink current corresponds to $Vdd>Vdd_0+\Delta V1$, where $Vdd_0+\Delta V1<Vmax$. The lower trigger voltage 356 that triggers APS 180 to source current corresponds to $Vdd<Vdd_0-\Delta V2$, where $Vdd_0-\Delta V2>Vmin$. This results in the APS 180 sourcing or sinking current as required to prevent an unsafe voltage condition. As an illustrative example, if $Vdd_0=1.0$ volts, Vmax may be 1.05 volts and Vmin may be 0.95 volts. The trigger voltages are preferably selected such that the APS does not source or sink current in response to periodic clock ripple such as a clock ripple of 0.01 volts. The upper and lower trigger voltagse may be further selected to achieve a comparatively high inductor voltage (to optimize the rate at which the inductor current changes). However, since the APS will have a finite response time to detect and respond to the voltage crossing beyond a trigger voltage level, the upper trigger voltage is preferably sufficiently below Vmax to reduce the likelihood of an overvoltage condition and the lower trigger voltage is preferably sufficiently above Vmin to reduce the likelihood of an undervoltage condition. As one example, $\Delta V1$ and $\Delta V2$ may be selected to be 0.03 volts (corresponding to an upper trigger voltage of 1.03 volts and a lower trigger voltage of 0.97 volts) such that there is a 0.2 volt margin to account for the finite response time of the APS to detect, respond, and modify the operating voltage.

Referring to FIG. 3B, plot 302 illustrates a step-increase in current demand versus time by a microprocessor, such as may occur when a logic circuit turns on. The increase in current demand at an initial time, t=0, results in the operating voltage 308 initially decreasing as decoupling capacitors discharge. When the operating voltage decreases to the lower trigger voltage the APS supplies current, as indicated by hatched area 305 to supplement the current 310 provided by the inductor. Since the voltage is allowed to rapidly decrease to the lower trigger voltage before APS 180 is triggered to source current, the inductor current increases at close to a maximum safe rate. This improves the speed at which the inductor responds. For the purposes of illustration, a comparison plot 320 (illustrated as a dashed line) shows how the inductor would respond if an active capacitor were used instead of an APS 180. An active capacitor would respond linearly to changes in voltage. Simulations indicate that an active capacitor would require about twice the circuit area (twice the capacitor area) and need to supply about twice the total charge as an APS 180 of the present invention to provide comparable voltage regulation in response to a multicycle change in current demand.

One aspect of the present invention is that the trigger voltage levels are selected to be greater than normal cycle-to-cycle variations associated with steady-state clock operation. In the present invention, current sourcing or sinking is triggered only in response to voltage changes sufficiently large to indicate a multicycle change in current demand, such as a change in logic current required by a microprocessor. Moreover, in a preferred embodiment, the trigger voltages are selected to permit the inductor to develop a sufficient voltage to result in a large rate of change of inductor current to reach the new multicycle current level in an optimum number of cycles without exceeding safe operating voltages for the microprocessor circuit.

FIG. 3C is a graph illustrating a simulation that includes the effects of resonance, cyclic clocks, and a change in logic current. As illustrated in section 360, the on-chip voltage will have some normal ripple voltage associated with the clocks during normal operation. For example, in a microprocessor with a nominal operating voltage of about 1.0 volts, the ripple may correspond to 10 mV swings with each clock cycle. A noise event 365, such as change in logic current, may occur. Plot 380 illustrates the on-chip voltage without APS 180. For this case, the voltage may oscillate over many clock cycles and exceed safe operating levels. Plot 370 illustrates the on-chip voltage with APS 180 active. With APS 180 active, current sourcing is triggered when the voltage level decreases below the lower trigger level. Conversely, current sinking is triggered when the voltage level exceeds the upper trigger level. Consequently, the voltage remains within safe operating levels in response to changes in current demand.

It is desirable that APS 180 be implemented as a compact circuit compatible with a conventional integrated circuit fabrication process such that one or more APSs 180 may be integrated onto a microprocessor. Moreover, it is desirable that APS 180 have a sufficiently fast response time that it can be used to regulate the voltage in high-speed microprocessors.

Figure 4:
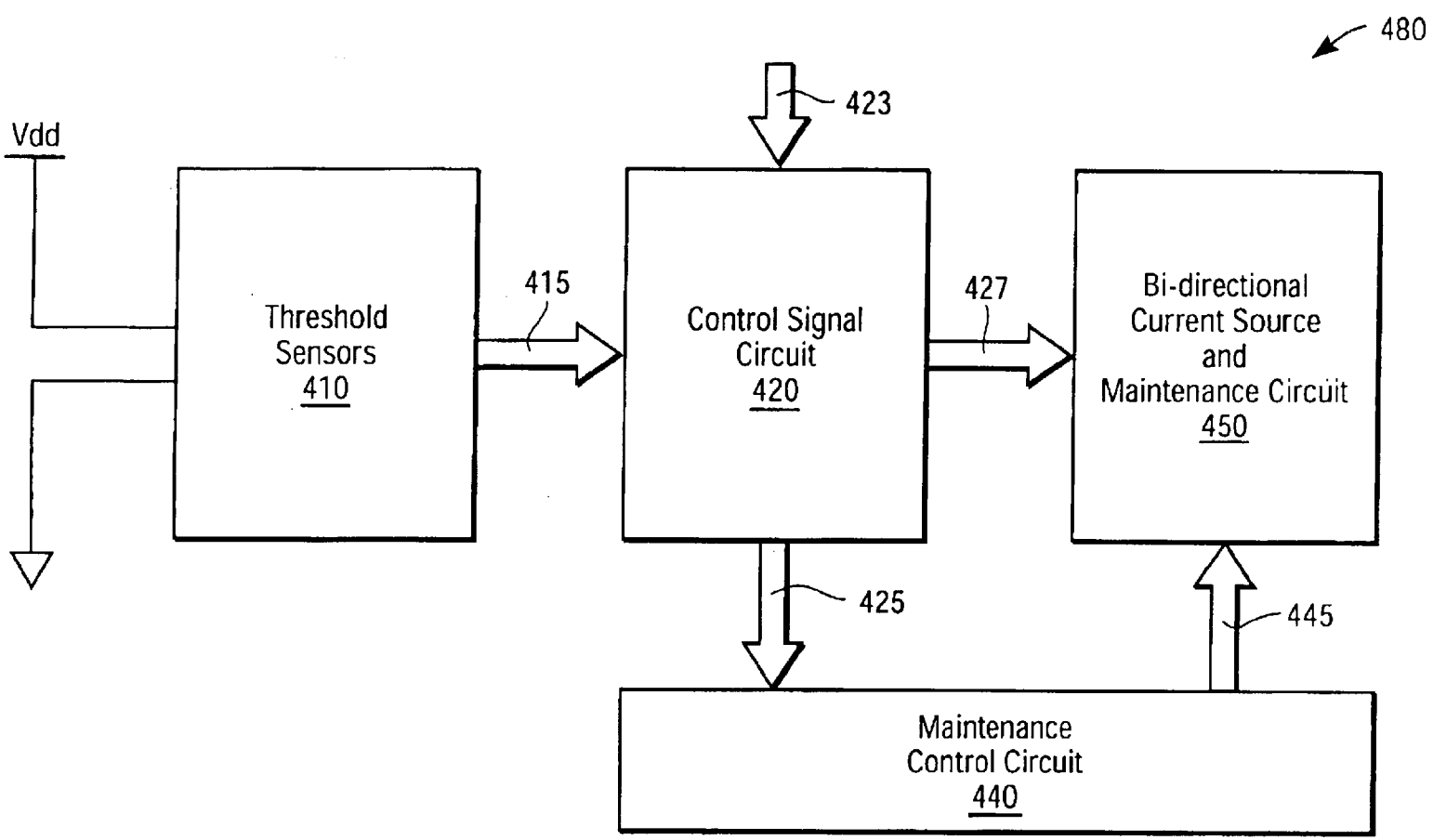
FIG. 4 is a block diagram illustrating a compact active power stabilizer circuit of the present invention.

FIGS. 4–11 describe a compact APS embodiment for use in high-speed microprocessors. FIG. 4 illustrates a functional block diagram of one embodiment of an active power stabilizer 480. APS 480 includes a threshold sensor 410 for sensing the microprocessor circuit voltage, Vdd, and generating a threshold signal 415, a control signal circuit 420 receiving the threshold signal 415 and generating control signals 427 indicative of a current source condition when current needs to be sourced or a current sink condition when current needs to be sinked; a bidirectional current source 450 including a switched capacitor network having capacitors and switches configured to couple capacitors in series to act as a current source in response to a current source control signal and to couple capacitors in parallel to act as a current sink in response to a current sink control signal; and a maintenance control circuit 440 coupled to the current source 450 and control circuit 420 configured to restore/maintain the capacitors in bidirectional current source 450 to a ready state voltage when the current source is not sourcing or sinking current. The maintenance control circuit preferably restores the capacitors to the ready voltage at a sufficiently slow rate that the bi-directional current source is not a significant current source/sink during the maintenance state.

Figure 5:
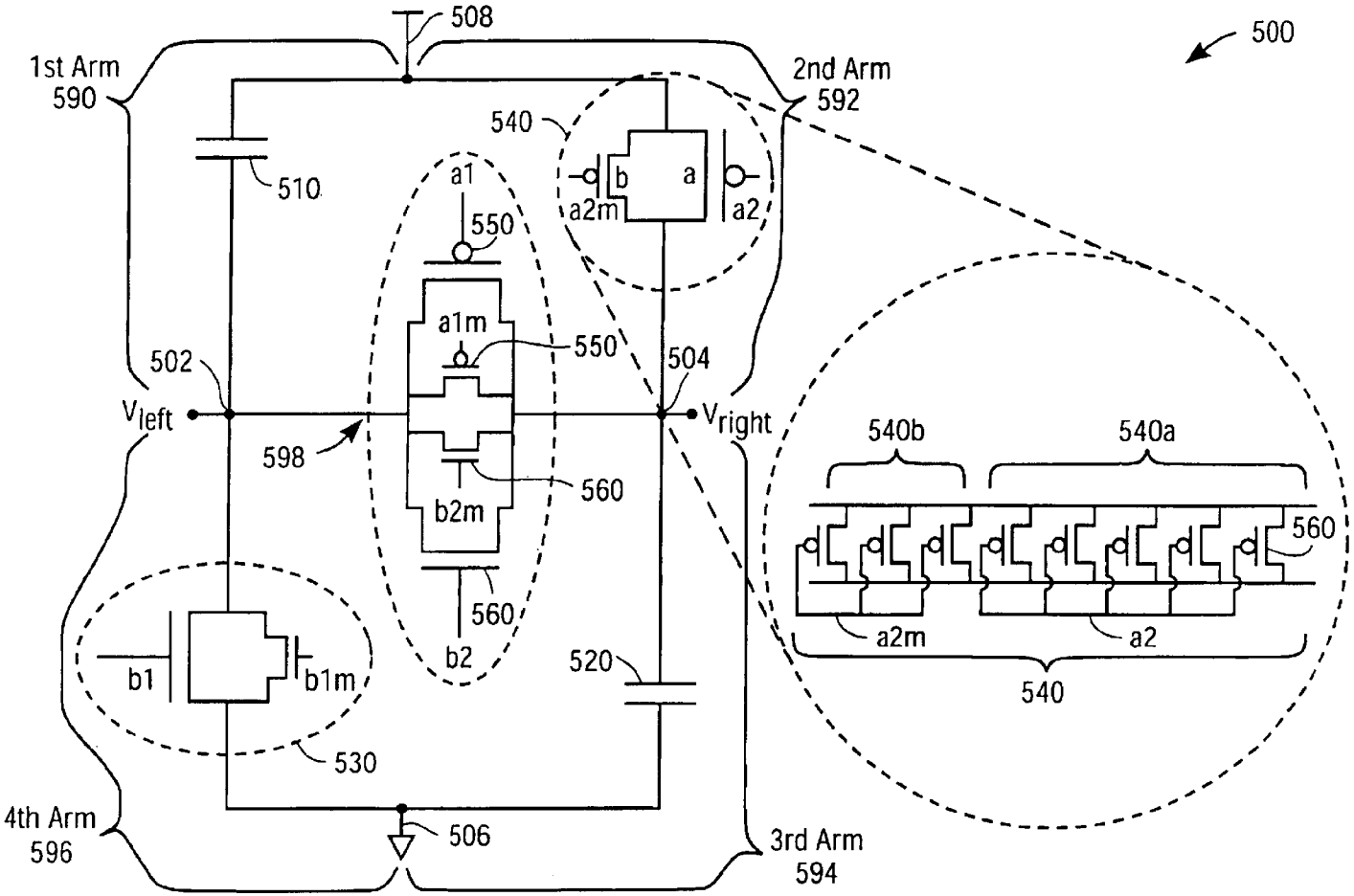
FIG. 5 illustrates a capacitor bridge circuit for forming a bi-directional current source.

In one embodiment, bi-directional current source 450 has a bridge circuit 500 including capacitors and switches arranged in a bridge topology, as illustrated in FIG. 5. A high voltage node 508 and a ground node 506 may be coupled to the power grid of an integrated circuit to source or sink current. A first arm 590 of the bridge between nodes 502 and 508 includes a first capacitor 510. A second arm 592 between nodes 508 and 504 includes switches 540*a* and 540*b*. A third arm 594 between nodes 504 and 506 includes second capacitor 520. A fourth arm 596 between nodes 506 and 502 includes switches 530*a* and 530*b*. A center bridge section 598 between nodes 502 and 504 includes a pair of switches 550*a*, 550*b*, 560*a*, 560*b* working in unison. Each arrangement of switches 530, 540, 550 and 560 preferably comprises a plurality of switches to permit the switches to be operated as either a high conductance switch or as a high resistance switch.

In one embodiment, the maintenance switches 530*b*, 540*b*, 550*b*, and 560*b* may be selectively turned on to act as resistive elements of voltage divider to restore the voltage across the capacitors to a desired level. Additionally, the resistance may be selected to restore the voltage over a time scale sufficiently large such when the voltage is being restored the APS is not a significant current source or sink with respect to the microprocessor circuit. As one example, assuming that each combined switch 530, 540, 550, 560 has the same total number of "fingers", a preferred embodiment has 20% of the fingers of combined switches 530 and 540 used as maintenance switches 530*b* and 540*b*, while 60% of the fingers of combined switches 550, and 560 are used to form maintenance switches 550*b*, and 560*b*. In one embodiment, with all maintenance switches 530*b*, 540*b*, 550*b*, 560*b* turned on, a voltage divider is formed placing 80% of the total voltage from Vdd to ground across each capacitor 510, 520.

The bridge 500 may be configured as a current sink having capacitors coupled in parallel by turning on the switches in the second arm and fourth arm, with the bridge section switched turned off. Conversely, the bridge may be configured as a current source having capacitors coupled in series by turning on the switches in the bridge section and turning off the switches in the second arm and the fourth arm. In a maintenance state, the voltage levels at nodes 502 and 504 are brought back to an equilibrium voltage value using a shunt voltage divider formed by turning on selected "m" transistors 530*b*, 540*b*, 550*b*, 560*b*. In an idle state (not shown), the switches in the second arm, fourth arm, and bridge may be left in an off state, resulting in the voltage floating at nodes 502 and 504.

Figure 6:
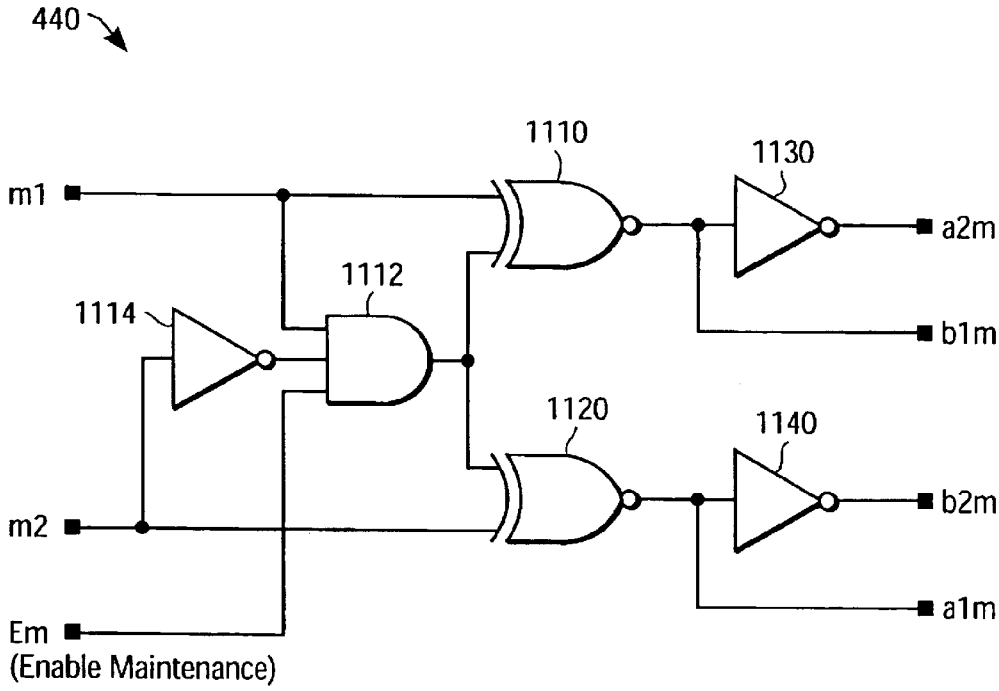
FIG. 6 illustrates an embodiment of a maintenance circuit for rebalancing the charge on capacitors in the bridge circuit in a maintenance state.

FIG. 6 illustrates a schematic of one embodiment of the maintenance control circuit 440 according to the present invention for generating control signals a1*m*, a2*m*, b1*m*, and b2*m*. Maintenance control circuit 440 comprises a first XNOR gate 1110, a second XNOR gate 1120, a first inverter 1130, a second inverter 1140, a third inverter 1114, and an AND gate 1112. The first XNOR gate 1110 is configured to receive m1 from control signal circuit 420 and to receive an output from the AND gate 1112. Second XNOR gate 1120 is configured to receive m2 from control signal circuit 420 and to receive the output from AND gate 1112. The AND gate 1112 receives m1, an inverted m2 via third inverter 1114, and Em from enable signal 423. The product of the AND gate 1112 is provided to the first and second XNOR gates 1110 and 1120 as noted above. The result of first XNOR gate 1110 is output as b1*m*, and is inverted by first inverter 1130 to be output as a2*m*. The result of second XNOR gate 1120 is output as aim and is inverted by second inverter 1140 to be output as b2*m*.

FIG. 7 illustrates an exemplary truth table showing illustrative logical signals and operating states of the circuit. It will be understood that the logic table is exemplary for the illustrated circuits, and that other circuits with different logical implementations may be utilized to form an APS 480.

In one embodiment, an enable signal, indicates whether the APS 480 should operate to regulate the power; Em which indicates whether the Maintenance control circuit 440 should enter a maintenance state or an idle state. By switching the APS 480 from the maintenance state to the idle state, a power savings may be realized, however, APS 480 may remain in the maintenance state indefinitely without detriment to its operation.

Figure 8:
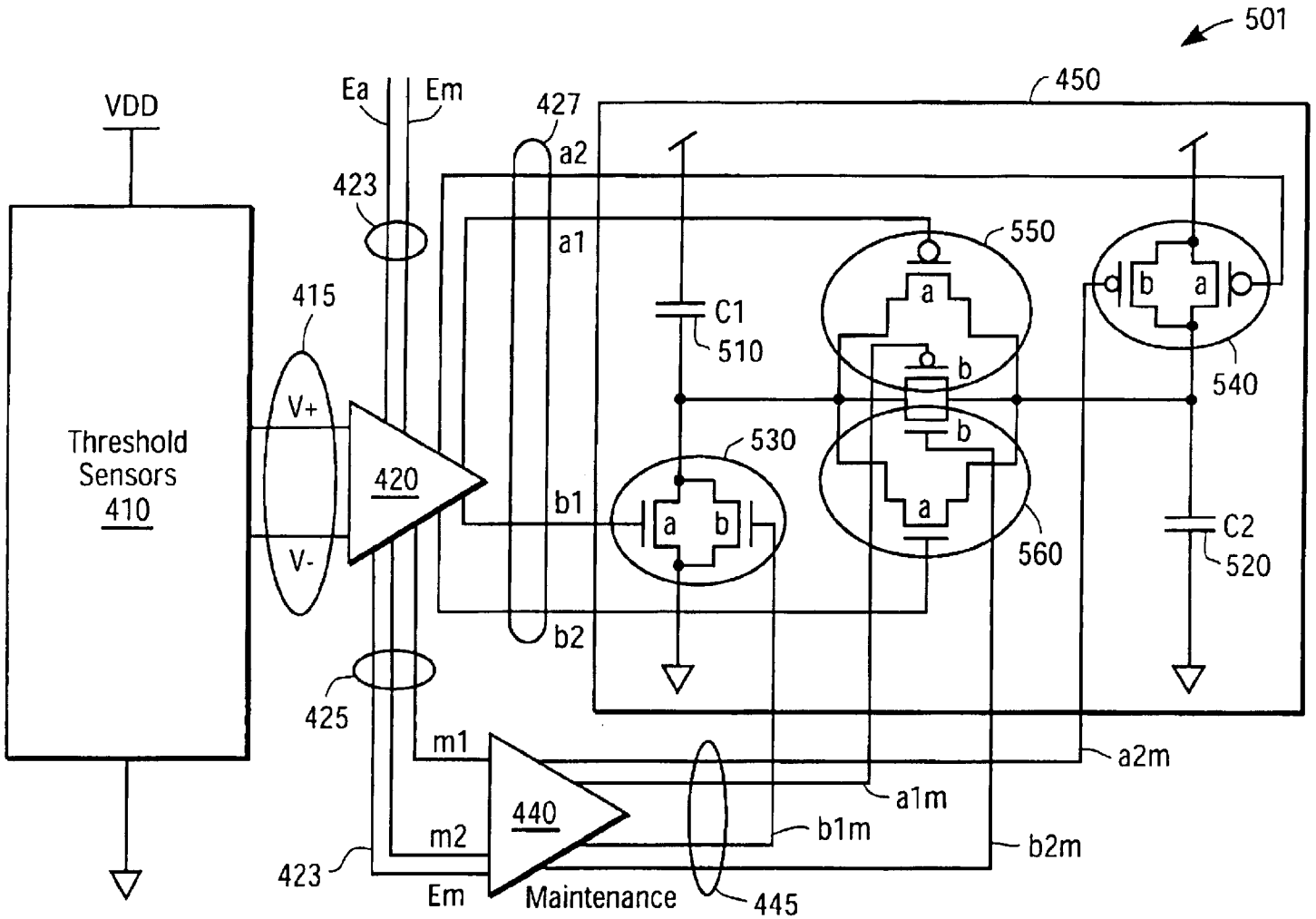
FIG. 8 is a block diagram illustrating some aspects of the threshold sensors and control circuit of the compact active power stabilizer.

For a high speed microprocessor circuit a sensitive, comparatively fast sensor circuit 410 to detect voltage changes requiring action along with a sufficiently fast control signal circuit 420 is desirable. FIG. 8 is a block diagram illustrating threshold sensors 410 coupled to control signal circuit 420 for regulating the action of bidirectional current source 450. Illustrative control signals 415, 425, 427, and 445 as well as the enable signal 423 are illustrated in FIG. 8. A threshold signal 415 includes a V+ signal indicating whether Vdd is above an upper threshold, and includes a V− signal indicating whether Vdd is below a lower threshold. First control signal 425 comprises two signals m1 and m2 which act as state bits and control the operation of maintenance control circuitry 440. Second control signal 427 comprises a1, a2, b1, and b2 signals that each control the operation and configuration of the current source 450. Likewise, maintenance control signal 445 comprises a1*m*, a2*m*, b1*m*, and b2*m* that control the maintenance circuit in the current source 450.

Figure 9B:
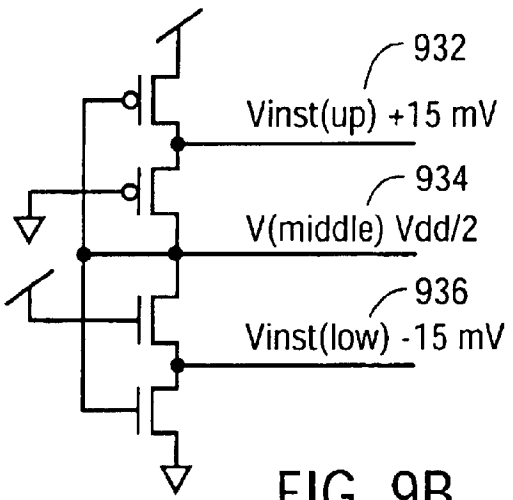
FIGS. 9A, 9B, 9C, and 9D illustrate sensor circuits.
Figure 9C:
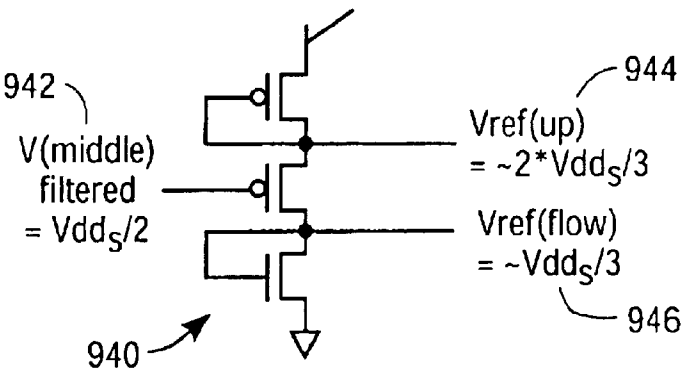
Figure 9A:
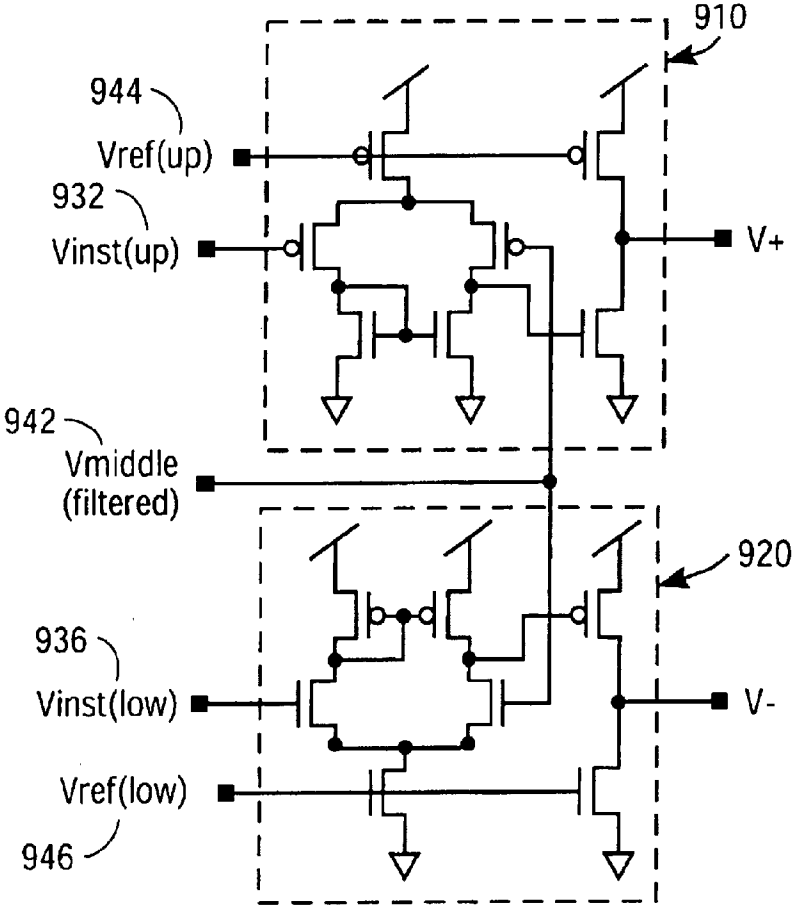

FIGS. 9*a*–9*d* illustrate one embodiment of the threshold sensors 410. As discussed above, threshold sensors 410 monitor and compare Vdd against threshold 352 and threshold 356. Threshold sensors 410 are configured to output a threshold signal 415 consisting of V+ and V−. As illustrated in FIG. 9*a*, the threshold sensors are comprised of two "current mirror" differential amplifiers, 910, 920.

The first differential amplifier 910, is a P-type amplifier and is used to determine whether Vdd is below the $Vdd_0-\Delta V2$, threshold 356. To accomplish the comparison, Vdd is first passed through a noise sensing "ladder" 930. FIG. 9*b* illustrates one embodiment of the noise sensing ladder 930. Ladder 930 is a resistor voltage divider configured to produce $V_{inst}$(up) 932, Vmiddle 934, and $V_{inst}$(low) 936. In the preferred embodiment, $V_{inst}$(up) 932 is approximately 15 mV above Vdd/2 for a 1V $Vdd_s$, $V_{inst}$(low) 936 is approximately 15 mV below vdd/2, and Vmiddle 934 is approximately equal to half of Vdd.

Figure 9D:
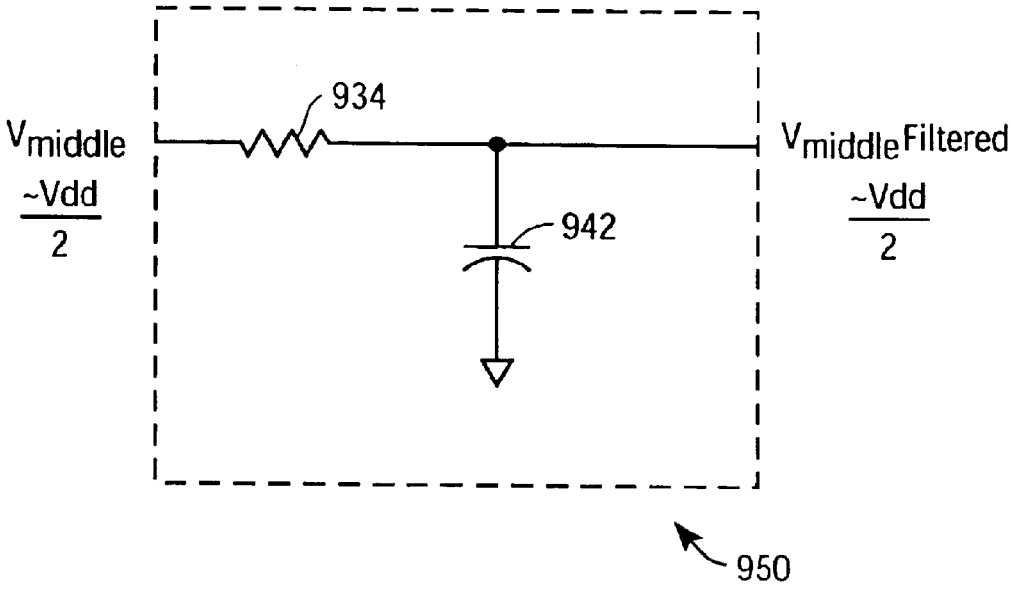

Referring to FIG. 9*d*, Vmiddle 934 is passed through a low pass filter 950 to generate Vmiddle(filtered) 942 which approximates 0.5 $Vdd_s$. The low pass filter is configured to remove voltage and current transients, leaving a stable voltage that is ½ voltage at node 290 as supplied by the external power supply and regulator 210. Vmiddle(filtered) 942 is also used by a reference resistor voltage divider 940 to produce $V_{ref}$(up) 944 and $V_{ref}$(low) 946. This voltage divider 940 is illustrated in FIG. 9*c*. In one embodiment $V_{ref}$(up) 944 is approximately ⅔ $Vdd_s$ and $V_{ref}$(low) 946 is approximately ⅓ $Vdd_s$.

Vmiddle(filtered) 942, $V_{inst}$(up) 932, and $V_{ref}$(up) 944 are provided to first differential amplifier 910 in order to compare $V_{inst}$(up) 932 with Vmiddle(filtered) 942. Since first differential amplifier 910 is configured to be a P-type amplifier, it generates a value of "0" for V+ when $V_{inst}$(up) 932 is greater than Vmiddle(filtered) 942 and outputs a value of "1" when $V_{inst}$(up) 932 is less than Vmiddle(filtered) 942.

The second differential amplifier 920 is an N-type amplifier that is used in a complementary fashion with respect to the first differential amplifier 910 to determine whether Vdd is above Vddo+ΔV1 threshold 352. Vmiddle(filtered) 942, $V_{inst}$(low) 936, and $V_{ref}$(low) 946 are provided to second differential amplifier 920 in order to compare $V_{inst}$(low) 936 with Vmiddle(filtered) 942. Second differential amplifier 920 is configured to be a N-type amplifier, and generates a value of "0" for V− when $V_{inst}$(low) 936 is greater than Vmiddle(filtered) 942 and outputs a value of "1" when $V_{inst}$(low) 936 is less than Vmiddle(filtered) 942.

Figure 10:
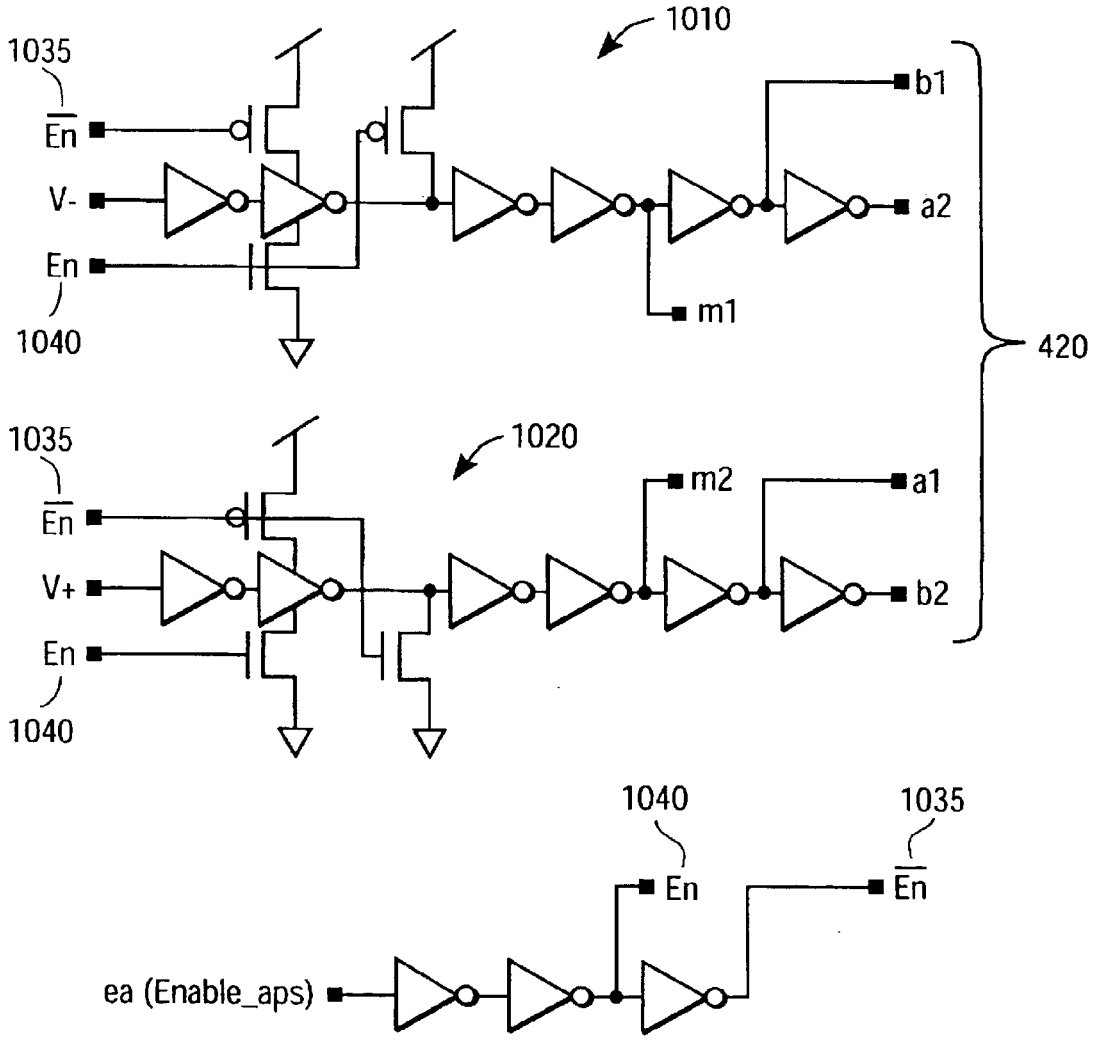
FIG. 10 illustrates control circuits.

FIG. 10 is a schematic of a control signal circuit 420 according to the present invention. Control signal circuit 420 comprises two inverter gain chains 1010, 1020. The gain chains 1010, 1020 are formed in a conventional manner from conventional inverters. The output from the differential amplifiers 910, 920 in threshold sensors 410 do not produce much current gain. To decrease the turn-on time of combined switches 530, 540, 550, 560, a higher current signal is required. The gain chains 1010, 1020, provide the higher current signals.

First gain chain 1010 receives and processes the V− signal from second differential amplifier 920. V− is passed through a plurality of inverters to rapidly develop a high current gain in order to drive the regular switches 530*a* and 540*a* via control signals b1 and a2. Signals b1 and a2 are configured to be drawn from different inverter stages in the first gain chain 1010 such that b1 is always opposite of a2 in value. However, as noted above, switch 540*a* is a N-FET design and switch 530*a* is a P-FET design, thus b1 and a2 effectively carry the same information adapted for their associated switch.

Likewise, second gain chain 1020 receives and processes the V+ signal from first differential amplifier 910. V+ is passed through a plurality of inverters to rapidly develop a high current gain in order to drive the regular switches 550*a* and 560*a* via control signals b2 and a1. Signals b2 and a1 are configured to be drawn from different inverter stages in the second gain chain 1020 such that b2 is always opposite of a1 in value. However, as noted above, switch 550*a* is a N-FET design and switch 560*a* is a P-FET design, thus b2 and a1 effectively carry the same information adapted for their associated switch.

Both gain chains 1010, and 1020 also include enabling circuitry to disable the APS 480 if needed. As illustrated, the enabling circuitry receives $\overline{\text{En}}$ 1035 and En 1040. En 1040 is an active-high enabling signal derived from Ea and $\overline{\text{En}}$ 1035 is its complement. If the APS 480 is disabled (Ea="0"), then first gain chain 1010 is configured to output a2 with a value of "1" and b1 with a value of "0", effectively turning off both switches 530*a* and 540*a*. Similarly, if APS 480 is disabled, second gain chain 1020 is configured to output b2 with a value of "0" and a1 with a value of "1", effectively turning off both switches 550*a*, and 560*a*.

First gain chain 1010 also generates m1 to signal maintenance control circuit 440. In the preferred embodiment, m1 holds the same value as V− assuming the APS 480 is enabled. If the APS 480 is not enabled, then m1 has a value of "1" regardless of the value of V+. Gain chain 1020 likewise generates m2 to hold the same value as V+ unless the APS 480 is disabled, at which point m2 has a value of "0".

It will be understood that the design of APS 180 for a particular application will depend upon many factors. In particular, the response turn on/turn off characteristics of APS 180 may be selected by varying parameters associated with the threshold sensors 410 and control signal circuit. In some applications it is desirable that the APS be able to turn on within a few cycles of sensing a voltage exceeding a trigger level. The turn off response to detecting the voltage returning below the trigger level may be identical to the turn-on response, although it will be understood that the turn on/turn off response may be skewed. For example, in some embodiments, the turn-on response may be faster than the turn-off response. The high and low trigger voltages $Vdd_0$+ΔV1, 352 and $Vdd_0$−ΔV2, 356, for which current sourcing and sinking are activated may be selected from computer simulations, such as by determining maximum voltage ranges likely to occur for likely variations in microprocessor current demands and determining trigger voltages for particular APS implementations that turn on sufficiently soon after detecting the trigger voltage and which source/sink sufficient current to prevent unsafe voltage conditions.

The invention has been presented by way of example in terms of several specific embodiments. One skilled in the art will recognize that several alternate embodiments may exist to control the current source and maintenance circuit of the present invention. Furthermore, one skilled in the art will recognize that several topologies may exist for forming the current source and maintenance circuit. It is not intended that the invention should be limited to the embodiments discussed herein, but should instead be defined by the claims which follow.

What is claimed is:

1. A packaged integrated circuit having a clock and an associated package inductance limiting the rate at which current supplied to a power grid of the packaged integrated circuit may change in response to a change in current demand of the packaged integrated circuit and a decoupling capacitance filtering an operating voltage, the packaged integrated circuit comprising:

a regulator circuit coupled to the power grid of the packaged integrated circuit for sourcing current to the packaged integrated circuit in a first operating state and sinking current from the packaged integrated circuit in a second operating state;

the first operating state corresponding to the operating voltage decreasing below a lower trigger voltage indicative of a first multicycle event that increases current demand during a first plurality of cycles of the clock of the packaged integrated circuit and the second operating state corresponding to the operating voltage increasing above an upper trigger voltage indicative of a second multicycle event that decreases current demand during a second plurality of cycles of the clock of the packaged integrated circuit;

the lower trigger voltage being above a minimum safe voltage and the upper trigger voltage being below a maximum safe voltage.

2. The integrated circuit of claim 1, wherein the regulator circuit includes at least two capacitors coupled by a switch network, the voltage regulator coupling the at least two capacitors in series to act as a current source in the first operating state and coupling the capacitors in parallel to act as a current sink in the second operating state.

3. The integrated circuit of claim 2, wherein the regulator circuit acts as a voltage divider to restore the voltage of the at least two capacitors during a third operating state corresponding to the operating voltage being between the first trigger voltage and the second trigger voltage.

4. The integrated circuit of claim 1, wherein the regulator circuit comprises a voltage sensor for measuring the operating voltage, bi-directional current source for sourcing current in the first operating state and for sinking current in the second operating state, and a controller for selecting the operating state of the bi-directional current source by comparing the operating voltage to a target regulated voltage.

5. A packaged integrated circuit, comprising:

a microprocessor circuit having a clock and a logic circuit;

a package having an associated package inductance for coupling current to the microprocessor circuit;

a decoupling capacitor for filtering the voltage of the microprocessor circuit;

a regulator circuit formed on the microprocessor circuit, comprising:

a sensor to measure an operating voltage, Vdd with respect to a target voltage Vdd0;

a bidirectional current source acting as a current source in a first operating state for sourcing current to the packaged integrated circuit, a current sink in a second operating state for sinking current from the packaged integrated circuit, and having a third operating state in which the bi-directional current source is neither a significant current source nor a significant current sink for the microprocessor circuit; an a controller circuit to select the operating state of the bi-directional current source, the controller selecting the first operating state responsive to the operating voltage being below a first trigger voltage that is less than Vdd0 by a first preselected voltage difference, indicative of a first multicycle event that increases current demand during a first plurality of cycles of the clock, selecting the second operating state responsive to the operating voltage being above a second trigger voltage, that is greater than Vdd0 by a second preselected voltage difference, indicative of a second multicycle event that decreases current demand during a second plurality of cycles of the clock, and selecting the third operating state when the operating voltage is between the first trigger voltage and the second trigger voltage;

the first trigger voltage selected to be greater than a lower safe voltage range and the second trigger voltage selected to be less than an upper safe voltage range.

6. The integrated circuit of claim 5, wherein the bi-directional current source comprises at least two capacitors coupled in series in the first operating state, in parallel in the second operating state, and restoring the voltage of the capacitors to a preselected voltage by a voltage divider in the third operating state.

7. The integrated circuit of claim 6, wherein the sensor comprises a ladder circuit.

8. The integrated circuit of claim 6, wherein the controller circuit comprises a logic driver.

9. The integrated circuit of claim 6, further comprising a maintenance circuit for controlling operation of the bi-directional current source in the third operating state.

10. For a packaged integrated circuit coupled to an external voltage regulator by a package inductance, a method of maintaining an operating voltage within a safe voltage range in response to a multicycle change in current demand by the packaged integrated circuit, the method comprising:

sensing an operating voltage, Vdd, of the packaged integrated circuit;

sinking current from the packaged integrated circuit responsive to a first multicycle event where Vdd is greater than a target operating voltage, Vdd0, by a first pre-selected voltage difference $\Delta V1$, indicative of a decrease of current demand during a first plurality of cycles of a clock;

sourcing current to the packaged integrated circuit responsive to a second multicycle event where Vdd is below the target operating voltage, by a second pre-selected voltage difference $\Delta V2$, indicative of an increase of current demand during a second plurality of cycles of a clock; and responsive to detecting Vdd being within the range $Vdd0-\Delta V2<Vdd<Vdd0+\Delta V1$ neither sourcing nor sinking current.

11. The method of claim 10, wherein the first and second preselected voltage differences are selected to be greater than a quasi-steady state clock ripple.

12. The method of claim 10, wherein the first and second preselected voltage differences correspond to a greater than 1% variation in operating voltage.

13. For a packaged integrated circuit coupled to an external voltage regulator by a package inductance limiting the rate at which the external voltage regulator can change the current that it supplies to the packaged integrated circuit and having a decoupling capacitance, a method of using a regulator circuit disposed on the packaged integrated circuit to maintain an operating voltage within a safe voltage range in response to a change in multicycle current demand by the packaged integrated circuit, the method comprising:

sensing an operating voltage, Vdd, of the packaged integrated circuit;

sinking current from the packaged integrated circuit responsive to detecting Vdd being greater than a target operating voltage, Vdd0, by a first pre-selected voltage difference $\Delta V1$ indicative of a first multicycle event that decreases current demand during a first plurality of cycles of a clock of the packaged integrated circuit;

sourcing current to the packaged integrated circuit responsive to detecting Vdd being below the target operating voltage, by a second pre-selected voltage difference $\Delta V2$ indicative of a second multicycle event that increases current demand during a second plurality of cycles of the clock of the packaged integrated circuit; and responsive to detecting Vdd being within the range $Vdd0-\Delta V2<Vdd<Vdd0+\Delta V1$ neither sourcing nor sinking current.

* * * * *